US011187456B2

(12) United States Patent
Remmel et al.

(10) Patent No.: US 11,187,456 B2
(45) Date of Patent: Nov. 30, 2021

(54) REFRIGERATING DEVICE FOR A RECREATIONAL VEHICLE

(71) Applicant: Dometic Sweden AB, Solna (SE)

(72) Inventors: Marcus Remmel, Roth (DE); Jörg Peter, Meinerzhagen (DE); Michael Steiger, Wenden (DE)

(73) Assignee: Dometic Sweden AB, Solna (SE)

( * ) Notice: Subject to any disclaimer, the term of this patent is extended or adjusted under 35 U.S.C. 154(b) by 0 days.

(21) Appl. No.: 16/328,079

(22) PCT Filed: Aug. 21, 2017

(86) PCT No.: PCT/EP2017/071052
§ 371 (c)(1),
(2) Date: Feb. 25, 2019

(87) PCT Pub. No.: WO2018/036975
PCT Pub. Date: Mar. 1, 2018

(65) Prior Publication Data

US 2019/0178570 A1 Jun. 13, 2019

(30) Foreign Application Priority Data

Aug. 26, 2016 (DE) ..... 10 2016 216 126.1

(51) Int. Cl.
*F25D 29/00* (2006.01)
*F25D 23/12* (2006.01)
*F25D 31/00* (2006.01)

(52) U.S. Cl.
CPC ..... *F25D 29/005* (2013.01); *F25D 23/12* (2013.01); *F25D 31/005* (2013.01); *F25D 2400/361* (2013.01)

(58) Field of Classification Search
CPC ..... F25D 23/12; F25D 29/00; F25D 29/005; F25D 31/005; F25D 2400/361
See application file for complete search history.

(56) References Cited

U.S. PATENT DOCUMENTS 2,166,534 A 7/1939 Rosenfeld
2,541,453 A 2/1951 West
(Continued)

FOREIGN PATENT DOCUMENTS

AU 2010278016 B2 8/2013
AU 2010254762 B2 1/2014
(Continued)

OTHER PUBLICATIONS

CN1690627A translation.*
(Continued)

*Primary Examiner* — Elizabeth J Martin
(74) *Attorney, Agent, or Firm* — Middleton Reutlinger

(57) ABSTRACT

The present invention is intended to provide a refrigerating device for a recreational vehicle, comprising a refrigerating chamber which is defined by side walls, an upper wall and a lower wall and a front opening, the refrigerating device further comprising a door which is configured to allow sealing of the front opening and to allow accessing the refrigerating chamber via the front opening, an input panel comprising a display, an input knob and a processing unit. The display depicts a plurality of items which correspond to a plurality of executable input methods to be triggered by a user via actuation of the input knob.

16 Claims, 7 Drawing Sheets

(56) References Cited

U.S. PATENT DOCUMENTS 2,624,909 A 1/1953 Khujawa
2,745,132 A 5/1956 Clark et al.
2,790,992 A 5/1957 Campbell
2,885,723 A 5/1959 Altmann
3,174,193 A 3/1965 Smith
3,403,473 A 10/1968 Navarro
3,889,419 A 6/1975 Maleck
4,014,178 A * 3/1977 Kells ..... F25D 29/005 62/3.6
4,132,034 A 1/1979 Van Siclen
4,495,673 A 1/1985 Khan
4,503,582 A 3/1985 Gurubatham
4,503,583 A 3/1985 Frohbieter
4,613,174 A 9/1986 Berg et al.
4,893,850 A 1/1990 Mizusawa
4,918,271 A 4/1990 Deeg
5,064,255 A 11/1991 Inui et al.
D342,743 S 12/1993 Renner
D342,744 S 12/1993 Renner
5,548,927 A 8/1996 Song
5,675,934 A * 10/1997 Park ..... E05D 15/505 49/193
5,829,197 A 11/1998 Oh
5,966,951 A 10/1999 Hallin et al.
5,966,963 A 10/1999 Kovalaske
6,000,771 A 12/1999 Wissinger et al.
6,401,482 B1 6/2002 Lee et al.
D468,325 S 1/2003 Lorek et al.
D468,326 S 1/2003 Lorek et al.
D468,327 S 1/2003 Lorek et al.
6,543,250 B1 4/2003 Mills et al.
D476,667 S 7/2003 Lorek et al.
D495,722 S 9/2004 Avalos Barcenas et al.
6,802,155 B1 10/2004 Kawabata et al.
D501,659 S 2/2005 Yamaji
6,868,692 B2 3/2005 Choi
D508,502 S 8/2005 Moseley
D540,831 S 4/2007 Kim et al.
D542,784 S 5/2007 Franck et al.
D544,856 S 6/2007 Hyodo
7,237,402 B2 7/2007 Hallin et al.
D550,256 S 9/2007 Lei et al.
D551,658 S 9/2007 Hussaini et al.
7,269,968 B2 9/2007 Harder et al.
7,278,569 B2 10/2007 Cohen et al.
7,296,432 B2 11/2007 Muller et al.
D563,998 S 3/2008 Doberstein et al.
D578,505 S 10/2008 Tejima et al.
7,516,515 B2 4/2009 LeimKuehler et al.
D595,887 S 7/2009 Blom
D604,340 S 11/2009 Kim et al.
D607,448 S 1/2010 Hui et al.
7,736,179 B2 6/2010 Cook et al.
D623,154 S 9/2010 Tu
7,913,355 B2 3/2011 Choi
D635,530 S 4/2011 Sung et al.
8,006,515 B2 8/2011 Hallin et al.
8,020,403 B2 9/2011 Rotter et al.
8,136,367 B2 3/2012 Froelicher et al.
8,146,383 B2 4/2012 Lorek et al.
D662,504 S 6/2012 Lohman
8,256,234 B2 9/2012 Watson et al.
D668,111 S 10/2012 Borjesson
8,281,611 B2 10/2012 Davis et al.
D673,144 S 12/2012 Onoue
8,322,805 B2 12/2012 Kwon et al.
D674,391 S 1/2013 Chatterjee et al.
8,375,734 B2 2/2013 Hall et al.
8,388,078 B2 3/2013 Kwon et al.
8,424,985 B2 4/2013 Kwon et al.
8,499,578 B2 8/2013 Ferragut, II et al.
8,506,026 B2 8/2013 Kim et al.
D691,608 S 10/2013 Samuels et al.
8,544,291 B2 10/2013 Kim et al.
8,544,973 B2 10/2013 Kwon et al.
8,567,885 B2 10/2013 Lee et al.
8,651,330 B2 2/2014 Krause et al.
8,651,331 B2 2/2014 Krause et al.
8,677,778 B2 3/2014 Jeon et al.
D701,888 S 4/2014 Schumaker et al.
8,695,371 B2 4/2014 Boarman et al.
8,701,940 B2 4/2014 Krause et al.
8,820,583 B2 9/2014 Kim
8,827,389 B2 9/2014 Lee et al.
8,875,538 B2 11/2014 Lee et al.
8,893,523 B2 11/2014 Talegaonkar et al.
8,925,344 B2 1/2015 Mitchell et al.
8,944,540 B2 2/2015 Kim et al.
D725,233 S 3/2015 Behling
9,021,828 B2 5/2015 Vitan et al.
9,022,494 B2 5/2015 Lehman et al.
9,097,454 B2 8/2015 LeClear et al.
9,115,924 B2 8/2015 Leclear et al.
D738,938 S 9/2015 Kamada et al.
9,127,871 B2 9/2015 Bortoletto et al.
9,170,040 B2 10/2015 An
D749,588 S 2/2016 Cox
9,297,573 B2 3/2016 Krause et al.
9,302,897 B2 4/2016 Dherde
9,309,103 B2 4/2016 Ergican et al.
D764,028 S 8/2016 Schoenherr et al.
D768,129 S 10/2016 Chen
D775,408 S 12/2016 Huyghe
D782,486 S 3/2017 Nalbandian et al.
9,672,998 B2 6/2017 Watanabe
D803,602 S 11/2017 Hightower et al.
D813,189 S 3/2018 Lundgard
D826,291 S 8/2018 Lim et al.
D839,318 S 1/2019 Meda et al.
D849,803 S 5/2019 Meda et al.
D865,007 S 10/2019 Meda et al.
10,488,954 B1 11/2019 Huang
D869,441 S 12/2019 Jeong et al.
10,634,417 B2 4/2020 Xingbiao et al.
D884,679 S 5/2020 Lin et al.
D887,459 S 6/2020 Olsson et al.
10,697,694 B2 6/2020 Steiger et al.
10,928,118 B2 2/2021 Xingbiao et al.
2003/0051407 A1 3/2003 Sosa
2004/0000028 A1 1/2004 Kim
2004/0148955 A1 8/2004 Johansson
2004/0172881 A1 9/2004 Minami
2005/0200253 A1 9/2005 Wissinger et al.
2005/0218765 A1 10/2005 Song et al.
2006/0170649 A1 8/2006 Kosugi et al.
2007/0176527 A1 8/2007 Sabelhaus et al.
2007/0216272 A1 9/2007 Park
2007/0227208 A1 10/2007 Ostberg
2007/0295024 A1 12/2007 Hallin et al.
2008/0047209 A1 2/2008 Hinterholzer et al.
2008/0048539 A1 2/2008 Beek et al.
2008/0202824 A1 8/2008 Philipp et al.
2008/0203739 A1 8/2008 Lim et al.
2008/0231159 A1 9/2008 Lee et al.
2009/0095011 A1 4/2009 Cho
2009/0142458 A1 6/2009 McCann
2009/0165478 A1 7/2009 Devos
2010/0126185 A1 5/2010 Cho et al.
2010/0218925 A1 9/2010 Candeo
2011/0036693 A1 2/2011 Lin et al.
2011/0113810 A1 5/2011 Mitchell et al.
2011/0162403 A1 7/2011 Selin et al.
2011/0252813 A1* 10/2011 Veltrop ..... A47J 39/006 62/3.3
2012/0000240 A1 1/2012 Junge et al.
2012/0023998 A1 2/2012 Oh et al.
2012/0023999 A1 2/2012 Oh et al.
2012/0024001 A1 2/2012 Oh et al.
2012/0102999 A1 5/2012 Anselmino et al.
2012/0146925 A1 6/2012 An et al.
2012/0159968 A1 6/2012 Doucet et al.
2012/0167611 A1 7/2012 Weirich et al.
2012/0222435 A1 9/2012 Lopes et al.
2012/0279247 A1 11/2012 Katu et al.

(56) References Cited

U.S. PATENT DOCUMENTS

| | | | |
|---|---|---|---|
| 2012/0324918 | A1 | 12/2012 | Bortoletto et al. |
| 2012/0326587 | A1 | 12/2012 | Jeong et al. |
| 2013/0161165 | A1 | 6/2013 | Han |
| 2014/0049926 | A1 | 2/2014 | Bas et al. |
| 2014/0075844 | A1 | 3/2014 | Walker et al. |
| 2014/0150460 | A1 | 6/2014 | Boarman et al. |
| 2014/0150468 | A1 | 6/2014 | Boarman |
| 2014/0150487 | A1 | 6/2014 | Boarman |
| 2014/0165601 | A1 | 6/2014 | Boarman et al. |
| 2014/0165602 | A1 | 6/2014 | Boarman |
| 2014/0165605 | A1 | 6/2014 | Boarman et al. |
| 2014/0165611 | A1 | 6/2014 | Boarman et al. |
| 2014/0223948 | A1 | 8/2014 | Visin |
| 2014/0246970 | A1* | 9/2014 | Park ..... F25D 29/005 312/404 |
| 2014/0260407 | A1 | 9/2014 | Boehringer et al. |
| 2015/0082812 | A1 | 3/2015 | Boarman et al. |
| 2015/0107285 | A1 | 4/2015 | Mitchell et al. |
| 2015/0123534 | A1 | 5/2015 | Kim et al. |
| 2015/0135762 | A1 | 5/2015 | Eveland et al. |
| 2015/0153093 | A1 | 6/2015 | Junge |
| 2015/0169005 | A1 | 6/2015 | Yanagida |
| 2015/0193073 | A1* | 7/2015 | Dmytriw ..... G06F 3/03547 345/174 |
| 2015/0225225 | A1 | 8/2015 | Tae et al. |
| 2015/0247668 | A1* | 9/2015 | Willis ..... F25D 29/005 62/129 |
| 2015/0276305 | A1 | 10/2015 | Hammond et al. |
| 2015/0284237 | A1 | 10/2015 | McMahan et al. |
| 2015/0293661 | A1 | 10/2015 | Gomez |
| 2015/0322694 | A1 | 11/2015 | Carr et al. |
| 2015/0330678 | A1 | 11/2015 | Hu |
| 2015/0330704 | A1 | 11/2015 | Kaymak et al. |
| 2016/0025406 | A1 | 1/2016 | An |
| 2016/0076187 | A1 | 3/2016 | Lee et al. |
| 2016/0076803 | A1 | 3/2016 | Pawar |
| 2018/0018023 | A1 | 1/2018 | Nakamura et al. |
| 2018/0224191 | A1* | 8/2018 | Marolda ..... F25D 29/00 |
| 2018/0307362 | A1 | 10/2018 | Komala et al. |
| 2019/0086139 | A1 | 3/2019 | Xingbiao et al. |
| 2019/0145140 | A1 | 5/2019 | Zhang et al. |
| 2019/0178564 | A1 | 6/2019 | Steiger et al. |
| 2020/0149334 | A1 | 5/2020 | Lundqvist et al. |
| 2020/0216229 | A1 | 7/2020 | Guan et al. |
| 2020/0378165 | A1 | 12/2020 | Steiger et al. |

FOREIGN PATENT DOCUMENTS

| | | | |
|---|---|---|---|
| AU | 2011248797 | B2 | 10/2014 |
| AU | 2014200864 | B2 | 3/2016 |
| AU | 201710975 | | 3/2017 |
| AU | 201710976 | | 3/2017 |
| AU | 201710992 | | 3/2017 |
| AU | 201710993 | | 3/2017 |
| AU | 201710991 | | 4/2017 |
| AU | 201717910 | | 2/2018 |
| AU | 201717920 | | 2/2018 |
| AU | 201810504 | | 2/2018 |
| AU | 201810505 | | 2/2018 |
| AU | 201810506 | | 2/2018 |
| AU | 201810658 | | 2/2018 |
| AU | 201810730 | | 2/2018 |
| AU | 201810733 | | 2/2018 |
| AU | 2017317557 | A1 | 2/2019 |
| AU | 2019284131 | A1 | 7/2020 |
| AU | 202110915 | | 3/2021 |
| AU | 202110916 | | 3/2021 |
| AU | 202110917 | | 3/2021 |
| AU | 202110918 | | 3/2021 |
| AU | 202110919 | | 3/2021 |
| AU | 202110920 | | 3/2021 |
| CA | 2582586 | A1 | 10/2007 |
| CA | 2638349 | A1 | 6/2009 |
| CA | 2670339 | A1 | 7/2010 |
| CA | 2706048 | A1 | 12/2010 |
| CA | 2757470 | A1 | 12/2010 |
| CA | 2706067 | A1 | 1/2011 |
| CA | 2755035 | A1 | 4/2012 |
| CN | 86206686 | U | 7/1987 |
| CN | 2084092 | U | 9/1991 |
| CN | 2108881 | U | 7/1992 |
| CN | 2150296 | Y | 12/1993 |
| CN | 2203997 | Y | 7/1995 |
| CN | 2209205 | Y | 10/1995 |
| CN | 2227188 | Y | 5/1996 |
| CN | 2243510 | Y | 12/1996 |
| CN | 2263178 | Y | 9/1997 |
| CN | 2272124 | Y | 1/1998 |
| CN | 1172939 | A | 2/1998 |
| CN | 2307895 | Y | 2/1999 |
| CN | 2315255 | Y | 4/1999 |
| CN | 2414148 | Y | 1/2001 |
| CN | 2429799 | Y | 5/2001 |
| CN | 2496973 | Y | 6/2002 |
| CN | 2498302 | Y | 7/2002 |
| CN | 2521560 | Y | 11/2002 |
| CN | 2558937 | Y | 7/2003 |
| CN | 1465837 | A | 1/2004 |
| CN | 2602131 | Y | 2/2004 |
| CN | 1690627 | A * | 4/2004 |
| CN | 2630763 | Y | 8/2004 |
| CN | 1540127 | A | 10/2004 |
| CN | 2867229 | Y | 2/2007 |
| CN | 101231115 | A | 7/2008 |
| CN | 201144611 | Y | 11/2008 |
| CN | 201152661 | Y | 11/2008 |
| CN | 201165779 | Y | 12/2008 |
| CN | 201173038 | Y | 12/2008 |
| CN | 201386456 | Y | 1/2010 |
| CN | 201434557 | Y | 3/2010 |
| CN | 101787839 | A | 7/2010 |
| CN | 201653044 | U | 11/2010 |
| CN | 201724505 | U | 1/2011 |
| CN | 201756879 | U | 3/2011 |
| CN | 102042733 | A | 5/2011 |
| CN | 202017423 | U | 10/2011 |
| CN | 102251729 | A | 11/2011 |
| CN | 102356289 | A | 2/2012 |
| CN | 102362131 | A | 2/2012 |
| CN | 102362132 | A | 2/2012 |
| CN | 102362134 | A | 2/2012 |
| CN | 202131939 | U | 2/2012 |
| CN | 202361741 | U | 8/2012 |
| CN | 202393147 | U | 8/2012 |
| CN | 202627839 | U | 12/2012 |
| CN | 202673061 | U | 1/2013 |
| CN | 202731625 | U | 2/2013 |
| CN | 202755782 | U | 2/2013 |
| CN | 202788468 | U | 3/2013 |
| CN | 203296635 | U | 11/2013 |
| CN | 103644696 | A | 3/2014 |
| CN | 203605570 | U | 5/2014 |
| CN | 203957955 | U | 11/2014 |
| CN | 203957956 | U | 11/2014 |
| CN | 203957958 | U | 11/2014 |
| CN | 203964501 | U | 11/2014 |
| CN | 203964502 | U | 11/2014 |
| CN | 203964503 | U | 11/2014 |
| CN | 203964506 | U | 11/2014 |
| CN | 203964508 | U | 11/2014 |
| CN | 203964522 | U | 11/2014 |
| CN | 203964529 | U | 11/2014 |
| CN | 203964534 | U | 11/2014 |
| CN | 203964546 | U | 11/2014 |
| CN | 203964547 | U | 11/2014 |
| CN | 203980760 | U | 12/2014 |
| CN | 104296467 | A | 1/2015 |
| CN | 204085031 | U | 1/2015 |
| CN | 104328966 | A | 2/2015 |
| CN | 104329879 | A | 2/2015 |
| CN | 104329880 | A | 2/2015 |
| CN | 104332862 | A | 2/2015 |
| CN | 104343305 | A | 2/2015 |

(56) References Cited

FOREIGN PATENT DOCUMENTS

| | | | |
|---|---|---|---|
| CN | 204282888 | U | 4/2015 |
| CN | 204359041 | U | 5/2015 |
| CN | 104677021 | A | 6/2015 |
| CN | 304201123 | S | 7/2017 |
| CN | 304444504 | S | 1/2018 |
| CN | 109059413 | A | 12/2018 |
| CN | 109642768 | A | 4/2019 |
| CN | 109642769 | A | 4/2019 |
| CN | 209623184 | U | 11/2019 |
| CN | 209893773 | U | 1/2020 |
| DE | 4428051 | A1 | 2/1995 |
| DE | 69301581 | T2 | 7/1996 |
| DE | 20021162 | U1 | 3/2001 |
| DE | 20204297 | U1 | 8/2002 |
| DE | 10256954 | A1 | 10/2003 |
| DE | 10307756 | A1 | 9/2004 |
| DE | 202004016063 | U1 | 2/2006 |
| DE | 202006007926 | U1 | 7/2006 |
| DE | 20221876 | U1 | 12/2008 |
| DE | 102012224167 | A1 | 7/2014 |
| DE | 102014200806 | A1 | 7/2015 |
| DE | 102016216126 | A1 | 3/2018 |
| DE | 102018213817 | A1 | 2/2019 |
| DE | 102017208901 | B4 | 6/2020 |
| DE | 102019200070 | A1 | 7/2020 |
| EP | 1096088 | B1 | 4/2004 |
| EP | 1492987 | A1 | 1/2005 |
| EP | 1538409 | A2 | 6/2005 |
| EP | 1329679 | B1 | 1/2007 |
| EP | 1873468 | A2 | 1/2008 |
| EP | 1895085 | A2 | 3/2008 |
| EP | 1953483 | A2 | 8/2008 |
| EP | 2054684 | A2 | 5/2009 |
| EP | 2426448 | A2 | 3/2012 |
| EP | 2430379 | A2 | 3/2012 |
| EP | 2492621 | A2 | 8/2012 |
| EP | 2562499 | A1 | 2/2013 |
| EP | 2717006 | A1 | 4/2014 |
| EP | 2738486 | A2 | 6/2014 |
| EP | 2765488 | A2 | 8/2014 |
| EP | 2896917 | A1 | 7/2015 |
| EP | 2133641 | B1 | 11/2015 |
| EP | 2998670 | A2 | 3/2016 |
| EP | 3287722 | A1 | 2/2018 |
| EP | 2357436 | B1 | 3/2018 |
| EP | 2405216 | B1 | 9/2018 |
| EP | 2927628 | B1 | 9/2018 |
| EP | 2998671 | B1 | 9/2018 |
| EP | 3475635 | A1 | 5/2019 |
| EP | 2908075 | B1 | 6/2019 |
| GB | 191316555 | A | 5/1914 |
| GB | 2107768 | A | 5/1983 |
| GB | 2209794 | B | 7/1991 |
| GN | 2675818 | Y | 2/2005 |
| GN | 1719168 | A | 1/2006 |
| GN | 104075531 | A | 10/2014 |
| JP | 52048247 | A | 4/1977 |
| JP | 52048248 | A | 4/1977 |
| JP | 52048250 | A | 4/1977 |
| JP | S5721169 | A | 2/1982 |
| JP | H02154972 | A | 6/1990 |
| JP | 2247479 | A | 10/1990 |
| JP | 2247480 | A | 10/1990 |
| JP | H02275278 | A | 11/1990 |
| JP | H0371087 | U | 7/1991 |
| JP | H03204581 | A | 9/1991 |
| JP | 3271476 | A | 12/1991 |
| JP | H04148180 | A | 5/1992 |
| JP | 4186011 | A | 7/1992 |
| JP | H06201253 | A | 7/1994 |
| JP | 7109864 | A | 4/1995 |
| JP | 7317441 | A | 12/1995 |
| JP | 9264091 | A | 10/1997 |
| JP | 11248339 | A | 9/1999 |
| JP | 11324518 | A | 11/1999 |
| JP | 3161680 | B2 | 4/2001 |
| JP | 2005164230 | A | 6/2005 |
| JP | 1020687 | B2 | 12/2007 |
| JP | 2008008610 | A | 1/2008 |
| KR | 200166856 | Y1 | 2/2000 |
| KR | 2004042748 | A | 5/2004 |
| KR | 2005027875 | A | 3/2005 |
| KR | 100756464 | B1 | 9/2007 |
| KR | 100880487 | B1 | 1/2009 |
| KR | 101005189 | B1 | 1/2011 |
| KR | 2014111723 | A | 9/2014 |
| TR | 199901774 | A2 | 3/2001 |
| TR | 200003328 | A2 | 6/2002 |
| TW | 200835840 | A | 9/2008 |
| WO | 03085339 | A1 | 10/2003 |
| WO | 2015078307 | A1 | 6/2015 |
| WO | 2015078311 | A1 | 6/2015 |
| WO | 2015078313 | A1 | 6/2015 |
| WO | 2015078314 | A1 | 6/2015 |
| WO | 2015078315 | A1 | 6/2015 |
| WO | 2015078316 | A1 | 6/2015 |
| WO | 2015078317 | A1 | 6/2015 |
| WO | 2015107118 | A1 | 7/2015 |
| WO | 2016026741 | A1 | 2/2016 |
| WO | 2018036975 | A1 | 3/2018 |
| WO | 2018037038 | A1 | 3/2018 |

OTHER PUBLICATIONS

Dometic Product Catalog, Refrigerators, 2015.

Dometic Product Catalog, Refrigerators, 2016.

Notice of Allowance issued in U.S. Appl. No. 16/327,492, dated Feb. 5, 2020.

Intention to Grant dated Jan. 31, 2020 for EP Application No. 16185380.9 filed on Aug. 23, 2016 entitled "Cabinet for a Recreational Vehicle".

European Patent Office, International Search Report and Written Opinion for PCT/EP2017/071052 dated Oct. 5, 2017.

AU Patent Application No. 2017316505 filed on Feb. 6, 2019.

EU Design Patent Application No. 003351253-0001-0016 filed on Aug. 24, 2016.

EU Design Patent Application No. 003351444-0001-0010 filed on Aug. 24, 2016.

CN Notice of Grant the Patent Right for Design Application received in 201730050701.0 dated Nov. 17, 2017.

CN First Office Action for Design Application received in 201730050701.0 dated Jul. 7, 2017.

Requirement for Restriction/Election issued in U.S. Appl. No. 29/594,930 dated Jan. 1, 2018.

Notice of Allowance issued in U.S. Appl. No. 29/594,930 dated Sep. 6, 2018.

U.S. Appl. No. 29/641,674 entitled "Control Panel" filed Mar. 23, 2018.

Non-Final Office Action issued in U.S. Appl. No. 29/594,936 dated Oct. 19, 2018.

Notice of Allowance issued in U.S. Appl. No. 29/594,936 dated Jan. 10, 2019.

CN Notice of Granting Patent Right for Design Application received in 201730050365.X dated Jun. 2, 2017.

DE Patent Application No. 102019209297.7 filed on Jun. 26, 2019.

DE Patent Application No. 102019207919.9 filed on May 29, 2019.

Non-Final Office Action issued in U.S. Appl. No. 16/327,492 dated Jun. 27, 2019.

European Patent Office, International Search Report and Written Opinion for PCT/EP2017/071216 dated Nov. 11, 2017.

European Patent Office, European Search Report and Opinion for 16185380.9 dated Feb. 17, 2017.

Office Action for EP Patent Application No. 177588423 dated Jul. 13, 2020.

Office Action for China Patent Application No. 2017800518667 dated Aug. 24, 2020.

Corrected Notice of Allowance issued in U.S. Appl. No. 16/327,492, dated Apr. 10, 2020.

(56) References Cited

OTHER PUBLICATIONS

Office Action for Germany Patent Application No. 102019207919.9 dated Mar. 4, 2020 (Summary in English attached).
Office Action for Germany Patent Application No. 102019209297.7 dated Mar. 12, 2020 (Summary in English attached).
Corrected Notice of Allowance issued in U.S. Appl. No. 16/327,492, dated May 13, 2020.
Decision to Grant mailed in EP Patent Application No. 16185380.9 dated Jun. 18, 2020.
Office Action for China Patent Application No. 201780051244.4 dated Jun. 17, 2020.
Non Final Office Action for Design U.S. Appl. No. 29/641,674 dated Oct. 1, 2020.
U.S. Appl. No. 16/884,698 entitled "Refrigerator with double-hinge Door" filed on May 27, 2020.
Second Office Action issued in China Patent Application No. 201780051244.4 dated Feb. 19, 2021.
Office Action Issued in Chinese Patent Application No. 201780051244.4 dated May 25, 2021.
U.S. Appl. No. 63/034,128, filed Jun. 3, 2020 titled "Refrigerator".
U.S. Appl. No. 16/198,009, filed Nov. 21, 2018 titled "Molded Frame for a Reversible Appliance Door".
Design U.S. Appl. No. 29/715,466, filed Dec. 2, 2019 titled "Refrigerator Appliance".

* cited by examiner

REFRIGERATING DEVICE FOR A RECREATIONAL VEHICLE

The present embodiments relate to a refrigerating device for a recreational vehicle and in particular to a refrigerator for a recreational vehicle.

A recreational vehicle in the sense of the invention may be a caravan, a mobile home, a yacht or any other vehicle being equipable with a refrigerating device. Such refrigerating devices comprise a refrigerating chamber that is defined by side walls, an upper and a lower wall and a front opening. Such refrigerating devices further comprise a door, which is configured to allow sealing of the front opening and to allow accessing the refrigerating chamber via the front opening, an input panel comprising a display, an input knob and a processing unit.

Recreational vehicles in general have limited space available for built-in components like refrigerating devices. Furthermore, refrigerating devices for recreational vehicles may require a much increased user interaction compared to refrigerating devices for stationary applications. More specifically, mobile refrigerating devices may have the option of selecting a specific source of power, adjusting the refrigerating temperature in order to maintain energy efficiency and also turning the mobile refrigerating device on and off again, which is most likely occurring more frequently compared to stationary applications of refrigerating devices.

Therefore, it is generally desired to provide a user-friendly interface for a convenient operation of the refrigerating device. The object of this invention is therefore to provide all relevant inputs for controlling the refrigerating device in a convenient and small in dimension set-up which is user-friendly and easy to use and operate.

The object is achieved by means of a refrigerating device with the features of claim 1. Favorable developments are provided in the dependent claims.

One embodiment of the refrigerating device for a recreational vehicle comprises a refrigerating chamber which is defined by side walls, an upper and a lower wall and a front opening. The refrigerating device further comprises a door which is configured to allow sealing of the front opening and to allow accessing the refrigerating chamber via the front opening, an input panel comprising a display, an input knob and a processing unit, wherein the display depicts a plurality of items which correspond to a plurality of executable input methods to be treated by a user via actuation of the input knob.

The refrigerating device according to the present invention thus has a panel that allows triggering all relevant commands for operating the refrigerator via an input knob and by means of selecting depicted items on a display. Processing user inputs via the input knob as well as computing the display is achieved by a processing unit. The terms "executable input method" relates to a predetermined algorithm or computational method for controlling an arbitrary component of the refrigerating device.

In some embodiments, each item of the plurality of items depicted on the display corresponds to a specific executable input method selected from the list, including setting a refrigerating temperature, preparing crushed ice or ice cubes, setting the source of energy, defrosting the refrigerating chamber, setting an alarm, controlling ventilation of the refrigerating chamber and adjusting the volume or light. Obviously, the list of specific executable input methods as provided before is not restricted thereto and may include any other executable input method useful for operating a refrigerating device. In some embodiments, the item depicted on the display which corresponds to a specific executable input method is depicted in a manner that allows anticipation of the intended functionality by intuition. In view of the above, the user may quickly identify the desired executable input method and trigger the same via actuation of the input knob.

In some embodiments, the input panel is fixedly mounted to the housing of the refrigerating device. By means of such a fixed arrangement, damages of the input panel, caused for example by accidental slamming of the door against objects inside the recreational vehicle, is substantially reduced. In some embodiments, the input panel is integrated into the body of the refrigerating device such that it is integrated smoothly and substantially without gaps between the input panel and the refrigerating device.

In one embodiment, the refrigerating device comprises a first refrigerating chamber and a second refrigerating chamber, whereas the first refrigerating chamber is a freezer and the second refrigerating chamber is a refrigerator. Controlling the later combination of refrigerating chambers may be achieved either by controlling both chambers via one control panel or by controlling each chamber via an individual control panel. Alternatively, the refrigerating device may comprise a different further refrigerating chamber which is accommodated on the inside of the refrigerating device. The term "refrigerating chamber" however is not limited thereto. According to the present embodiments, it is also possible to provide a chamber in addition to or as substitution for an already present refrigerating chamber. For instance, a combination of a refrigerating chamber with a cabinet, a microwave, an oven or the like into the refrigerating device is also possible to be controlled via the input panel. Accordingly thereto, one embodiment constitutes a combination of a refrigerating chamber with an oven.

The refrigerating device of the present invention, thus, preferably comprises a further chamber, whereas the further chamber is an oven. The oven is also connected with and to be controlled via the input panel. With this preferred configuration, the present invention provides a one compact device for heating and cooling which is centrally controllable by one input panel. The plurality of items depicted by the display, thus, further correspond to a plurality of executable input methods for the oven to be triggered by a user via actuation of the input knob.

In some embodiments, the specific executable input methods concerning the oven include one or more methods selected from the list consisting of turning gas on and off, setting a heating temperature, setting a heating mode like, for example, top heat, bottom heat, circulating air, rotisserie grill and combinations thereof, various time settings like, for example, a starting time and a duration for the heating, setting an alarm, controlling ventilation of the oven chamber, setting light settings and adjusting the volume.

In at least one embodiment, the oven is the top chamber of the refrigerating device of the present invention. This is advantageous since air warmed from the oven rises to the top which would adversely affect the refrigerating chamber if it would be the other way round.

Further, the input panel placed above and/or below a door of a refrigerating chamber of a refrigerating device, such that the panel is substantially at the same height as an upper and/or a lower wall of a refrigerating chamber of the refrigerating device. Thus, the spaces above or below a door of a refrigerating chamber may effectively be consumed by the panel according to the embodiments. Advantageously, formerly dead space is now effectively used, thus the overall dimensions of the refrigerating device may be reduced. In one embodiment, the control panel is placed such that it is directly adjacent to a horizontal door of the refrigerating device.

Preferably, the processing unit operatively connects the display unit display knob such that triggering an input method is achieved by rotating the input knob to select at least one of the depicted items corresponding to the desired input method and by pressing the input knob to execute the desired input method corresponding to the selected depicted item. Here, triggering an input method requires two inputs, namely a) selecting of an item by means of rotating the knob and b) execution of the input method that corresponds to the selected item by pressing the input knob. This approach provides an easy to use, easy to understand and failure-safe triggering of a desired input method. The input knob therefore has two degrees of freedom, namely rotation about its access of rotation and lateral movement along its access of rotation. Naturally, further degrees of freedom might be introduced for selecting and/or executing input methods, for example tilting the knob about its access of rotation or laterally shifting the knob in parallel to its access of rotation. Furthermore, pressing the input knob may optionally also open a sub-menu which is depicted on the display after pressing the input knob. In general, rotating the input knob corresponds to swiping through menu items and pressing the knob corresponds to confirming or activating the currently selected item.

The door of the refrigerating device may be hinged at a left and/or right side of the refrigerating chamber and comprises at least one handle to access the refrigerating chamber. In a preferred embodiment, the handle is a vertical notch, protruding into the inside of the door of the refrigerating device. Preferably, the door of the refrigerating device may be open both to the left side and to the right side by means of suitable left and right hinge and locking mechanisms.

The panel may constitute an integral part of the refrigerating device. In the sense of the embodiments, the input panel of the refrigerating device incorporates further functionalities, such as providing parts of the housing structure, providing a supporting structure or constituting a part of the frame of the refrigerating device. It is advantageous, to integrate the input panel such that it is easily to be connected with the devices to be controlled via the input panel.

The input panel forms a substantially even surface and the input knob is the only protruding component on the input panel. In the sense of the embodiments, the presence of gaps, protrusions or recesses shall be reduced to a minimum, in order to reduce the chance of dirt, dust or food remains accumulating on the input panel. By doing so, cleaning of the outside surfaces of the refrigerating device may easily be achieved. Also, during times without constantly maintained cleaning procedures, for example during times when the recreational vehicle is not used, accumulation or growth of potentially harmful substances or biologic material on the input panel is minimized. Therefore, no other protrusion except for the protruding input knob shall be present. The display of the input panel is covered by a transparent section of an input panel cover, in order to achieve an even surface with respect to the input panel and the adjacent components of the refrigerating device.

The input knob may be the only controlling device on the input panel. In the sense of the invention, the user inputs for controlling the refrigerating device shall only be provided via the input knob, in order to reduce the complexity of production, assembly and maintenance of the input panel. Also, the user interaction is much more intuitive, hence fail safe, if only one input knob is present.

The invention will now be described in more detail with reference to the figures showing a preferable embodiment, wherein.

Figure 1:
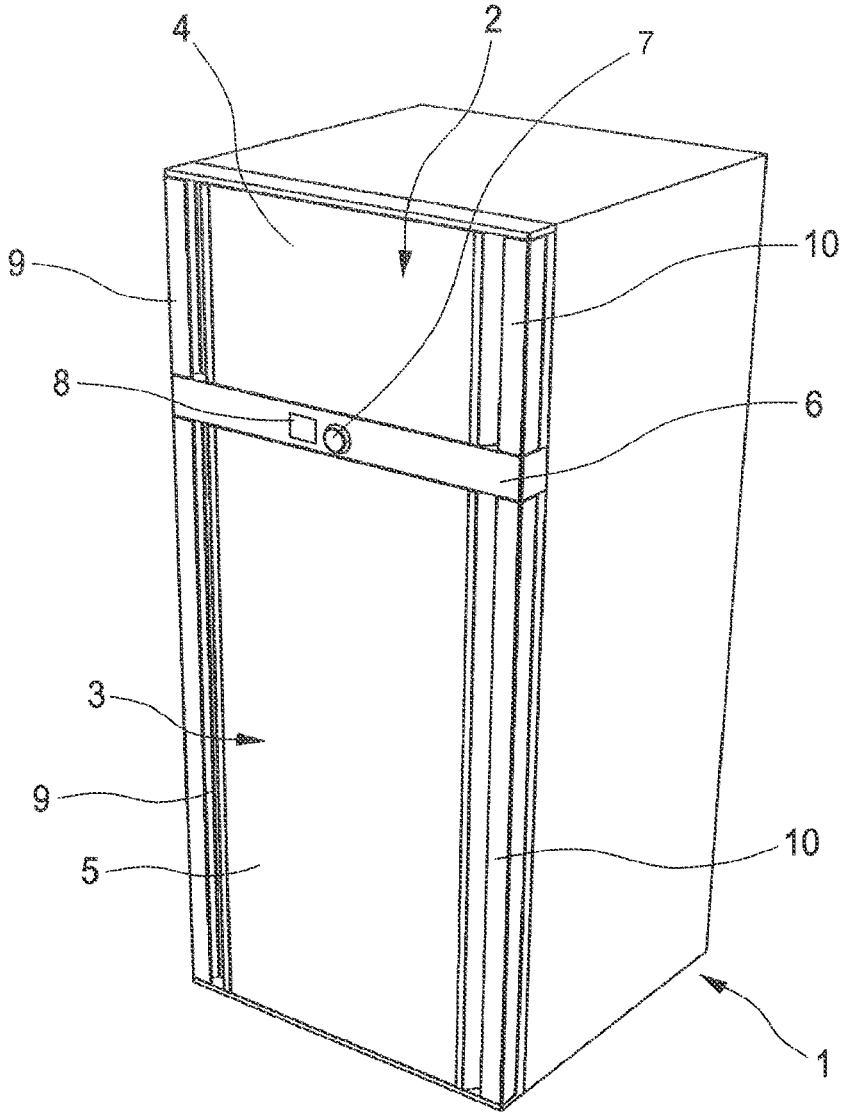
FIG. 1 is a prospective view of the refrigerating device according to a first embodiment of the invention comprising a first refrigerating chamber and a second refrigerating chamber.

In this particular embodiment of FIG. 1 the refrigerating device 1 comprises a first refrigerating chamber 2, e.g. a freezing compartment, and a second refrigerating chamber 3, e.g. a cooling compartment. Accordingly, the first refrigerating chamber has a first door 4 and a second refrigerating chamber 3 has a second door 5. In between the first door 4 and the second door 5 on the front side of the refrigerating device 1 is provided an input panel 6 with an input knob 7 and a display 8. Each of the first door 4 and the second door 5 comprises a left handle 9 and a right handle 10 for individually and selectively opening the first door 4 and/or the second door 5 to either the left or the right side. Thereby, the input panel 6 remains stationary attached to the refrigerating device 1. The input panel is further shaped such that it follows the encompassing surface of the refrigerating device without forming protrusions or recesses. The input panel 6 is further provided in a height that corresponds with the lower wall of the first refrigerating chamber 2 and the upper wall of the second refrigerating chamber 3 in order to make use of the dead space in between the first refrigerating chamber 2 and the second refrigerating chamber 3.

Figure 2:
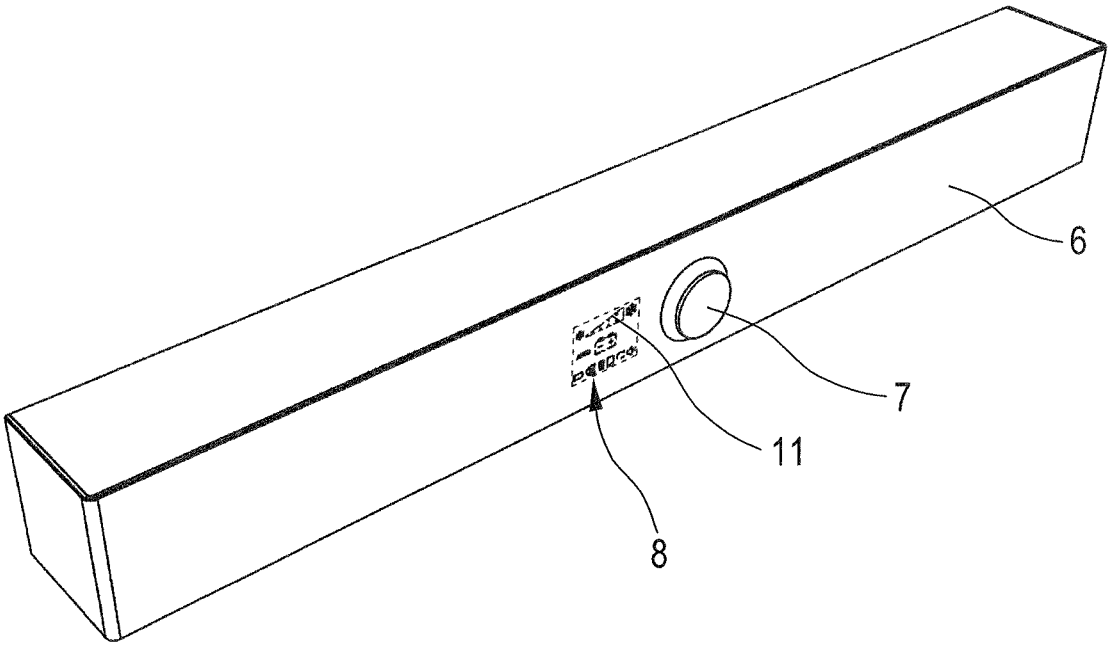
FIG. 2 is a prospective view of an isolated input panel according to the invention.

In FIG. 2, the input panel is shown in more detail. It is shown that the input knob has a circular shape and is provided on the right side next to a rectangular display 8 showing a plurality of items 11 which correspond to specific executable input methods and operating modes that may be selected by rotating the input knob 7 and which may be executed by pressing the input knob 7 when the desired item 11 is selected.

Figure 3:
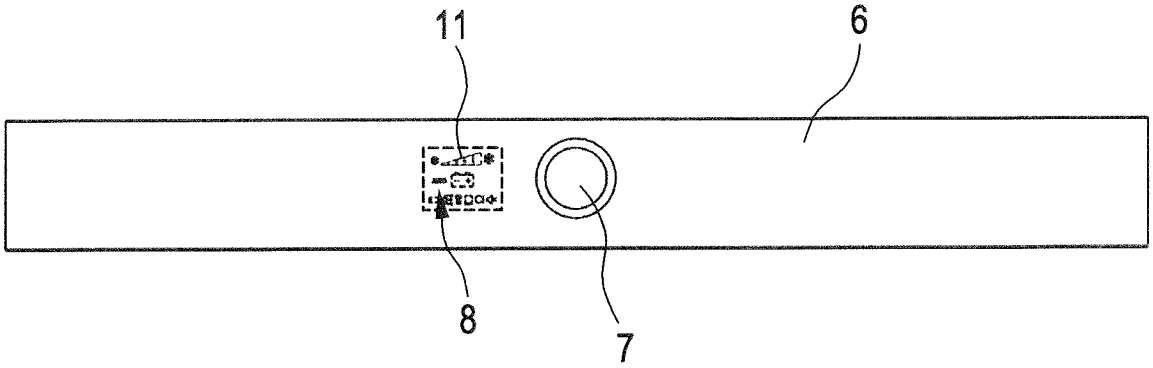
FIG. 3 is a front view of an isolated input panel according to the invention.
Figure 4:
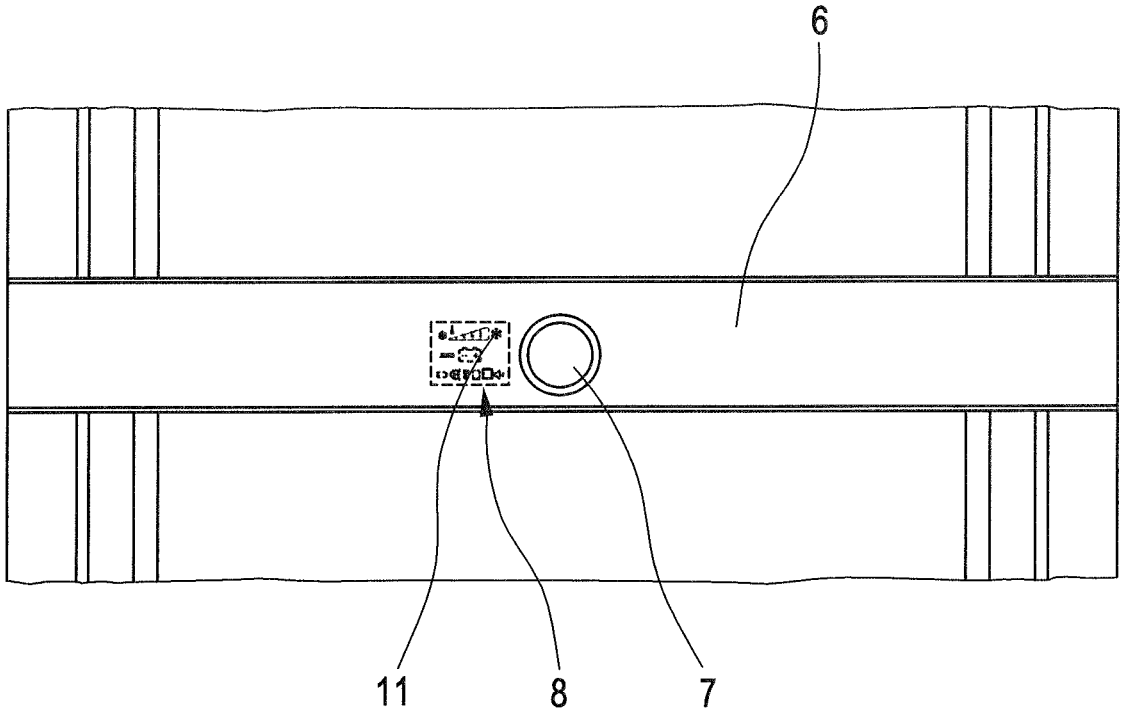
FIG. 4 is section of a refrigerating device according to a first embodiment of the invention in a front view showing the input panel.

FIG. 3 shows a front view of the isolated input panel 6 and FIG. 4 the input panel 6 as shown in FIG. 3 in combination with the refrigerating device 1. Here it is shown a plurality of items 11 consisting of symbols representing temperature, battery, power source, defrosting, volume control, ventilation and the like.

Figure 5:
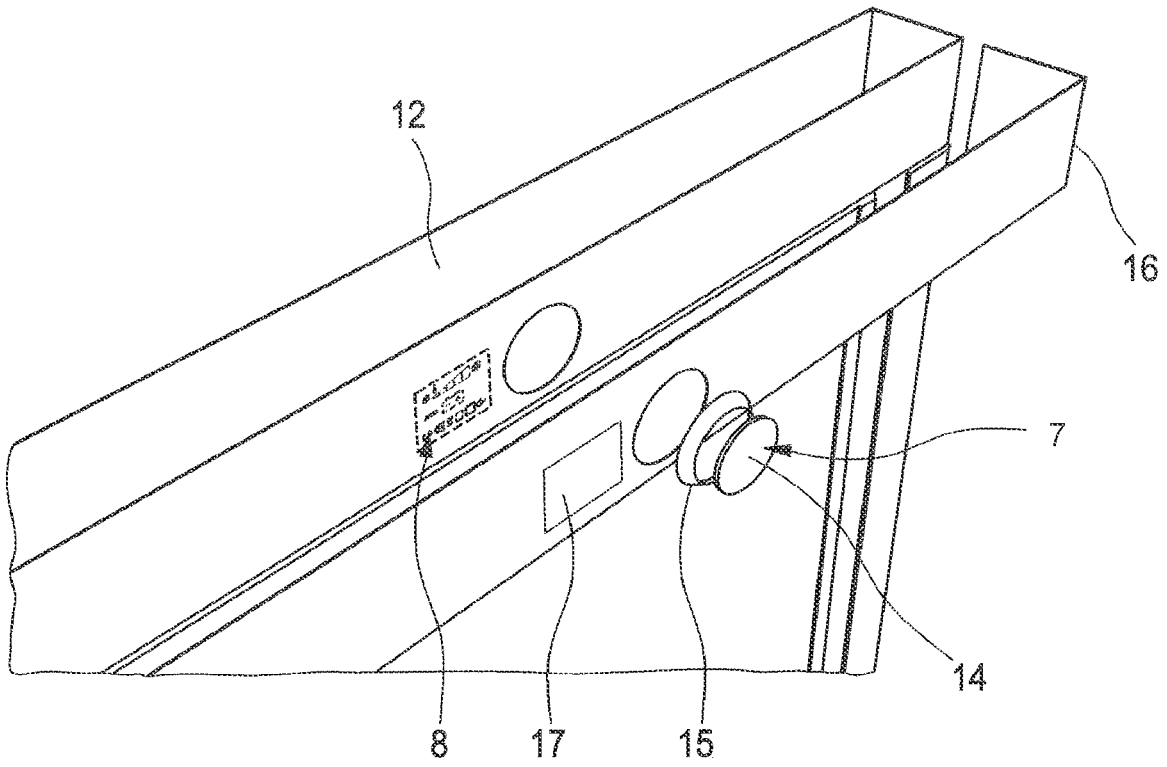
FIG. 5 is an exploded view of the input panel according to the invention.

The individual components of the input panel 6 are further shown in FIG. 5. The input panel 6 mainly consists of an input panel core 12, housing the processing unit (not shown), and the display 8, the input knob 7, consisting of a circumferential plate 14 and a ring 15 as well as a cover panel 16. The ring 15 is placed in between the cover panel 16 and the circumferential plate 14. The input panel 16 further comprises a transparent section 17 which aligns with the display 8 that is provided in the input panel core 12 in position and dimension. Thus, the display 8 may conveniently be observed in a mounted condition of the input panel 6, whilst being protected through the cover panel 16.

Figure 6:
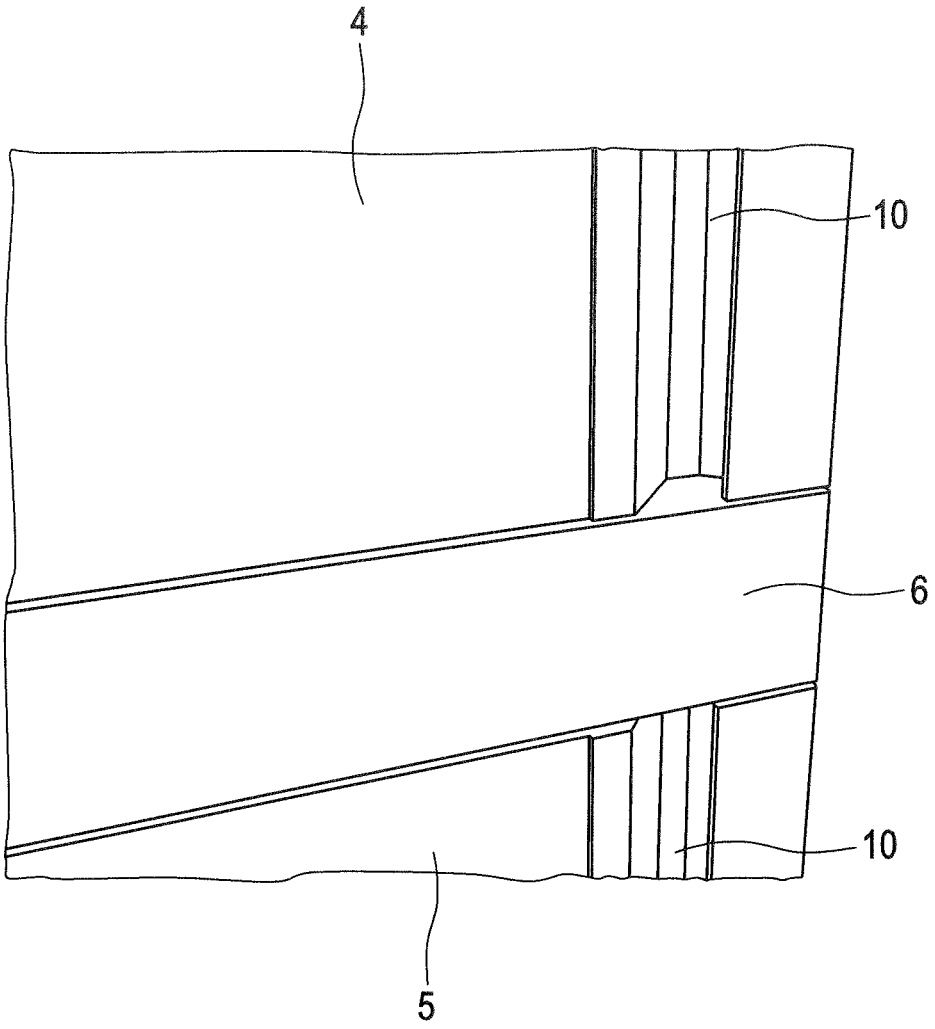
FIG. 6 is a prospective sectional view of a refrigerating device according to a first embodiment of the invention.

FIG. 6 shows a prospective sectional view of a refrigerating device 1 according to a first embodiment of the invention. It can be seen that the input panel 6 is located adjacent to the first door 4 of the first refrigerating chamber 2 and the second door 5 of the second refrigerating chamber 3. Furthermore, each of the first door 4 of the first refrigerating chamber 2 and the second door 5 of the second refrigerating chamber 3 have vertical right handles 9, 10 to open the doors 4, 5 individually and selectively either to the right side or to the left side.

Figure 7:
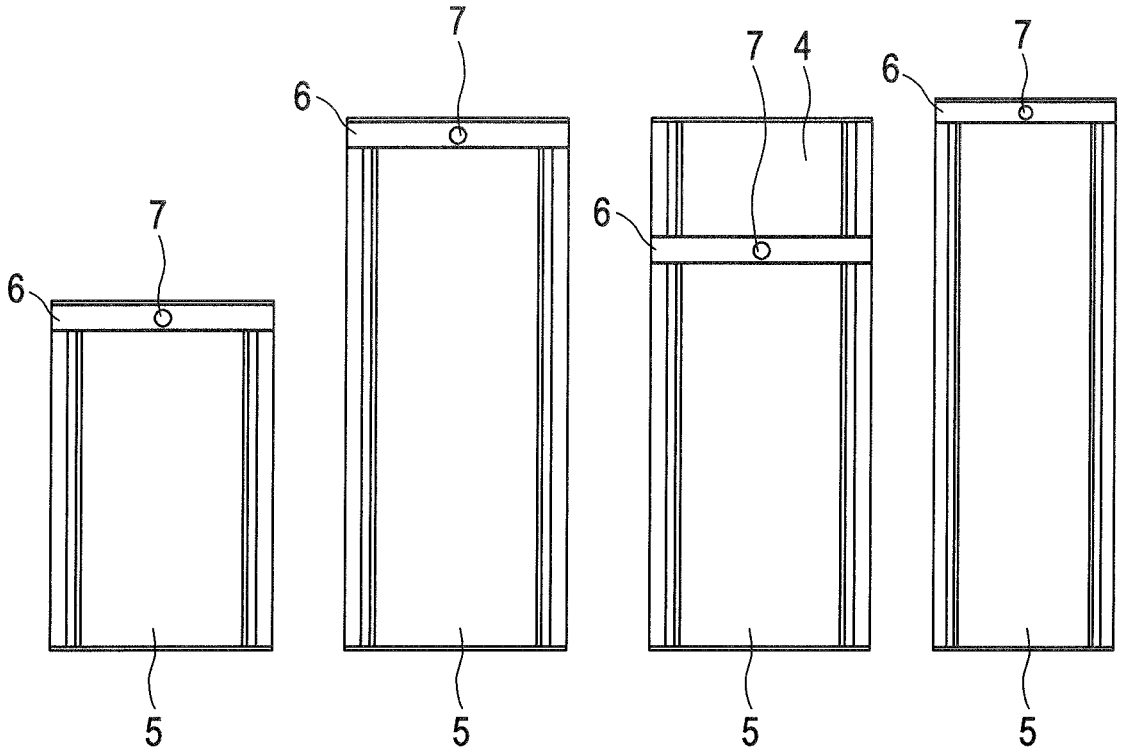
FIG. 7 is a front view showing several embodiments of a refrigerating device 1 for a recreational vehicle.

FIG. 7 depicts a variety of further embodiments of a refrigerating device 1 according to the invention. Accordingly, the refrigerating device 1 may either have only one refrigerating chamber, or a first refrigerating chamber 2 and a second refrigerating chamber 3. In either embodiment, the input panel 6 is fixedly provided on the front of the refrigerating device 1 above and/or below a door of the refrigerating chamber of the refrigerating device. The latter is specifically useful, since normally, this dead space would be covered by the doors or an additional blind. Here, the usually unused space is turned into a conveniently reachable space for housing the input panel 6.

The invention claimed is:

1. A refrigerating device for a recreational vehicle, comprising:

a first chamber and a second chamber which are defined by side walls, one of said first or second chambers disposed above the other of the first or second chambers, an upper wall and a lower wall and a first front opening, a first door which is configured to allow sealing of the first front opening and to allow accessing the first chamber via the first front opening, a second front opening, a second door which is configured to allow sealing of the second front opening and to allow accessing the second chamber via the second front opening, an input panel extending from a forward facing side wall of the side walls, the input panel comprising a display, the input panel disposed on a front of a housing of the refrigerating device, and being stationary, between the first door and the second door, said input panel extending horizontally and disposed adjacent to the first front opening and the second front opening, an outer surface of said input panel being flush with outer surfaces of said first door and said second door, an input knob, wherein the display depicts a plurality of items which correspond to a plurality of executable input methods to be triggered by a user via rotation and pressing of the input knob.

2. The refrigerating device according to claim 1, wherein each item of the plurality of items depicted on the display corresponds to a specific executable input method selected from a list, including one of or a plurality of setting a refrigeration temperature, preparing crushed ice or ice cubes, setting a source of energy, defrosting the first chamber or the second chamber, setting an alarm, controlling ventilation of the first or the second chamber, setting light settings or adjusting the volume.

3. The refrigerating device according to claim 1, wherein the input panel is fixedly mounted to the housing of the refrigerating device.

4. The refrigerating device according to claim 1, wherein the first chamber is a freezer and the second chamber is a refrigerator.

5. The refrigerating device according to claim 1, wherein the second chamber is an oven.

6. The refrigerating device according to claim 5, wherein each item of the plurality of items depicted on the display corresponds to a specific executable input method, whereas the specific executable input methods for specifically controlling the oven include one or more methods selected from a list consisting of turning gas on and off, setting a heating temperature, setting a heating mode various time settings, controlling ventilation of the oven chamber, setting light settings or adjusting the volume.

7. The refrigerating device according to claim 5, wherein the oven is a top chamber of the first and second chambers of the refrigerating device.

8. The refrigerating device according to claim 1, wherein the input panel is at the same height as a space between the first door and the second door of the refrigerating device.

9. The refrigerating device according to claim 1, further comprising the display being operably connected with the input knob such that triggering an input method is achieved by said rotation the input knob to select at least one of the depicted items corresponding to the input method and by said pressing the input knob to execute the desired input method corresponding to the selected depicted item.

10. The refrigerating device according to claim 1, wherein the input panel further comprises a cover panel with a transparent section.

11. The refrigerating device according to claim 1, wherein the input panel constitutes an integral part of the refrigerating device.

12. The refrigerating device according to claim 1, wherein the input panel forms an even surface and the input knob is the only protruding component on the input panel.

13. The refrigerating device according to claim 1, wherein the input knob is the only controlling device on the input panel.

14. The refrigerating device according to claim 1, wherein the first door and the second door of the refrigerating device are each hinged at a left and right side of the chambers and each said first door and said second door comprises at least one handle to access the chambers.

15. The refrigerating device according to claim 6, wherein the heating mode comprises top heat, bottom heat, circulating air, rotisserie grill or combinations thereof.

16. The refrigerating device according to claim 6, wherein the various time settings comprise a starting time and a duration for the heating, and setting an alarm.

* * * * *